US009393613B2

(12) United States Patent
Jiang et al.

(10) Patent No.: US 9,393,613 B2
(45) Date of Patent: Jul. 19, 2016

(54) METHOD FOR MANUFACTURING HOLLOW INGOT FOR RETAINING RING OF LARGE GENERATOR BY ELECTROSLAG REMELTING

(71) Applicant: Northeastern University, Shenyang, Liaoning Province (CN)

(72) Inventors: ZhouHua Jiang, Shenyang (CN); FuBin Liu, Shenyang (CN); Xu Chen, Shenyang (CN); HuaBing Li, Shenyang (CN); XiMin Zang, Shenyang (CN); Xin Deng, Shenyang (CN)

(73) Assignee: NORTHEASTERN UNIVERSITY, Shenyang, Liaoning Province (CN)

( * ) Notice: Subject to any disclaimer, the term of this patent is extended or adjusted under 35 U.S.C. 154(b) by 76 days.

(21) Appl. No.: 14/559,293

(22) Filed: Dec. 3, 2014

(65) Prior Publication Data

US 2016/0045952 A1 Feb. 18, 2016

(30) Foreign Application Priority Data

Aug. 13, 2014 (CN) ..... 2014 1 0396737

(51) Int. Cl.

| | |
|---|---|
| ***B22D 7/04*** | (2006.01) |
| ***B22D 23/10*** | (2006.01) |
| ***B22D 2/00*** | (2006.01) |
| ***B22D 27/02*** | (2006.01) |
| ***B22D 27/04*** | (2006.01) |
| ***C22B 9/18*** | (2006.01) |

(52) U.S. Cl.

CPC *B22D 7/04* (2013.01); *B22D 2/003* (2013.01); *B22D 23/10* (2013.01); *B22D 27/02* (2013.01); *B22D 27/04* (2013.01); *C22B 9/18* (2013.01)

(58) Field of Classification Search

CPC ..... B22D 23/10; B22D 7/04; C22B 9/18
USPC ..... 164/421, 464, 470, 497, 509, 515
See application file for complete search history.

(56) References Cited

U.S. PATENT DOCUMENTS

2011/0214830 A1* 9/2011 Holzgruber ..... B22D 11/006 164/4.1

FOREIGN PATENT DOCUMENTS

| | | | | |
|---|---|---|---|---|
| AT | WO 0161060 A1 * | 8/2001 | ..... | B22D 11/006 |
| AT | 409729 B * | 10/2002 | ..... | B22D 11/006 |
| CN | 103334015 | 10/2013 | | |

OTHER PUBLICATIONS

EPO machine translation of AT 409729 B, Oct. 25, 2002.*

*Primary Examiner* — Kevin E Yoon
(74) *Attorney, Agent, or Firm* — Muncy, Geissler, Olds & Lowe, P.C.

(57) ABSTRACT

A method for manufacturing hollow ingot for retaining ring of large generator by electroslag remelting, comprising the following steps: (1) preparing consumable electrode assemblies; (2) melting slag into molten slag; (3) inserting one consumable electrode assembly into an electroslag remelting hollow ingot mold; (4) switching on two transformers; (5) pouring the molten slag into the electroslag remelting hollow ingot mold; (6) forming a current circuit among a stub, the consumable electrode assembly and a water-cooled bottom plate; (7) forming a current circuit among the upper segment, the water-cooled bottom plate and the transformer; (8) regulating the output current and voltage of the two transformers; (9) starting a withdrawing device to withdraw; (10) exchanging the consumable electrode assembly; (11) inserting a subsequent consumable electrode assembly into the molten slag, and repeating steps (8) to (10) until withdrawing is completed.

6 Claims, 2 Drawing Sheets

METHOD FOR MANUFACTURING HOLLOW INGOT FOR RETAINING RING OF LARGE GENERATOR BY ELECTROSLAG REMELTING

CROSS-REFERENCES TO RELATED APPLICATION

This application claims the priority of Chinese patent application No. 201410396737.X, filed on Aug. 13, 2014, which is incorporated herewith by reference.

BACKGROUND OF THE INVENTION

1. Field of the Invention

The present invention belongs to the field of metallurgical technology, in particular relates to a method for manufacturing hollow ingot for retaining ring of large generator by electroslag remelting.

2. The Prior Arts

It is determined by the constitution of primary energy source in China that coal-fired power plants are predominant, and this is the biggest challenge for China in controlling greenhouse gas emissions. Therefore, using less coal to generate more electric power and using coal in a clearer and more effective way have become the strategic issues related to the sustainable development of China's national economy, wherein one of the most important ways is to develop supercritical and ultra supercritical generating units with high capacity and high parameters so as to increase the thermal efficiency of the generating units. Retaining ring of a steam turbine generator is a critical component for thermal power generator and is a ring-shaped forging used for fastening winding coils on both ends of a generator rotor. The retaining ring is also used for preventing the coils on both ends of a driving motor rotor from flying off under centrifugal action. The retaining ring works in the environmental conditions of high speed, high stress, corrosion and high magnetic field, therefore, the quality of the retaining ring is in direct relation to the safe operation of the whole generating unit, and the retaining ring is thus one of the most critical components of a steam turbine generator unit. Meanwhile, the higher the capacity of the generating unit is, the larger the size of the retaining ring is required.

The traditional manufacture method for retaining ring is to use a solid ingot as forging material, and the solid ingot needs to be processed into a hollow ingot first. The manufacture process comprises the steps of manufacturing a solid ingot through electric furnace melting and electroslag remelting; heating the solid ingot to a forgeable temperature range; upsetting and punching with a 10,000-ton open forging press to make the solid ingot into a hollow ingot with a certain inside diameter; inserting a mandril into the hollow ingot; and stretching the hollow ingot while hole expansion. In order to ensure the interior quality of the ingot, the forging deformation at each time needs to be slight. However, the ingot is extremely prone to cracking during repeated-heating slight-deformation free forging. Forging has to be stopped at any time when cracks are found, and the cracks can only be removed after the ingot is cooled. After the cracks are removed, the ingot needs to be heated to the forgeable temperature range again to proceed with the forging, and the preparation of the hollow ingot is not completed until the inside and outside diameters both reach required dimensions.

The traditional method for manufacturing hollow ingot for retaining ring has complex process and low forging yield, and a large amount of material is wasted during punching process.

As multiple heating and deformation processes are used, the internal structure of the ingot is prone to change, and forging cracks are prone to form but difficult to remove. Repeated cooling and heating have a serious impact on the quality of the product, thus it is difficult to prepare hollow ingot for super-sized retaining ring, and product accuracy and material uniformity cannot be ensured.

SUMMARY OF THE INVENTION

In consideration of the shortage of the existing method for manufacturing hollow ingot for retaining ring, the present invention provides a method for manufacturing hollow ingot for retaining ring of large generator by electroslag remelting process. The present invention uses an electroslag remelting device composed of two power supplies, water cooled T-shaped internal and external molds and electrode lifting devices, to manufacture a hollow ingot for retaining ring of large generator with uniform composition and good surface quality by adjusting the slag composition for withdrawing type electroslag remelting and controlling the operation of electroslag remelting.

The method for manufacturing hollow ingot for retaining ring of large generator by electroslag remelting of the present invention comprises the following steps:

(1) Preparing a plurality of consumable electrode assemblies, each of which is composed of two parts with the same size;

(2) Adding slag into a slag melting furnace, and powering on to melt the slag into molten slag;

(3) Before pouring the molten slag, lowering the consumable electrode assembly by consumable electrode lifting devices and inserting them into a mold for electroslag remelting of hollow ingot; the mold mentioned above is composed of a T-shaped external mold and an internal mold, wherein the internal mold is composed of a water cooled sleeve and a cross beam on the top of the water cooled sleeve, the cross beam is fixed on the upper flange of the T-shaped external mold, and a cooling water channel is arranged in the water cooled sleeve for allowing cooling water to flow; the T-shaped external mold comprises an upper segment and a lower segment, between which an insulation blanket is arranged and which are respectively provided with a water cooled device; the insulation blanket is located below the level of molten slag; the lower segment of the T-shaped external mold is also installed with a liquid metal level detecting device; before molten slag pouring, during electroslag remelting and before demoulding, there is cooling water flowing in the cooling water channel of the water cooled sleeve and in the water cooled devices of the upper segment and the lower segment of the T-shaped external mold;

(4) Connecting a stub and a water-cooled bottom plate respectively with two terminals of one transformer; connecting the upper segment of the T-shaped external mold and the water-cooled bottom plate respectively with two terminals of the other transformer; switching on the two transformers;

(5) Pouring the molten slag into the mold when the molten slag is heated to 1650° C. to 1680° C.;

(6) As the level of the molten slag rises with slag pouring, forming an electric circuit among the stub, the consumable electrode assembly and the water-cooled bottom plate when the consumable electrode assembly comes into contact with the molten slag, and stopping pouring molten slag when the current reaches 8 to 9 kA;

(7) After pouring the molten slag into the mold, forming a circuit among the upper segment, the water-cooled bottom plate and the transformer connected with them when the molten slag comes into contact with the upper segment, and the current increases with pouring of the molten slag and rising of slag temperature;

(8) Regulating the output current and voltage of the two transformers to the process set value, wherein the current of the transformer connected with the stub and the water-cooled bottom plate is regulated to the process set value of current by electrode movement, and the voltage of the transformer is regulated to the process set value of voltage by a saturable reactor; meanwhile, regulating the output voltage of the transformer connected with the mold and the water-cooled bottom plate to keep the current of the transformer within 8 to 10 kA after the current of the that transformer reaches 5 to 6 kA;

(9) The consumable electrode assembly gradually melt in the molten slag, and the formed metal drops through slag gradually gather to the space between the mold and the water-cooled bottom plate, so that the level of the liquid metal rises gradually; when the level of the molten metal comes into contact with the liquid metal level detecting device, the liquid metal level detecting device gets a detection signal; at this time, the withdrawing device is started to drive the water-cooled bottom plate to descend for stripping withdrawing;

(10) Exchanging the consumable electrode assembly when the height of the remaining part of the consumable electrodes is 50 to 80 mm; lifting the remaining consumable electrode assembly through the consumable electrode lifting devices to separate from the molten slag, which makes the current between the stub and the water-cooled bottom plate to be cut off; whereas the power supplying the upper segment of the T-shaped external mold and the water-cooled bottom plate continuously to keep difference between the temperature of the molten slag and the temperature of the slag during electroslag remelting not more than 30° C. so as to avoid slag solidification caused by rapid decline of the temperature of the molten slag due to power cut;

(11) Inserting a subsequent consumable electrode assembly into the molten slag in the electroslag mold by the consumable electrode lifting device until the current formed among the stub, the consumable electrode assembly and the water-cooled bottom plate reaches 8 to 9 kA, and repeating steps (8) to (10) until withdrawing is completed, thereby obtaining large hollow ingots for retaining ring of large generator.

According to the method, the liquid metal level detecting device, the consumable electrode lifting devices and the withdrawing device are controlled by a computer control system; at the beginning of the withdrawing, the level of the liquid metal is controlled by matching the lowering speed of the consumable electrode with the withdrawing speed; when the level of the liquid metal is higher than the position of liquid metal level detecting device, increase the withdrawing speed; when the level of the liquid metal is lower than the position of liquid metal level detecting device, reduce the withdrawing speed; control the level of the liquid metal at the just right position of the liquid metal level detecting device.

According to the method, the two parts with the same size of the consumable electrode assembly are symmetrical and are connected in parallel and distributed at both sides of the cross beam.

The slag contains 35%-40% of $CaF_2$, 30%-35% of CaO, 10%-15% of $Al_2O_3$, 1%-5% of MgO and 10%-15% of $SiO_2$ by weight percentage.

According to the method, the upper segment of the T-shaped external mold and the water-cooled bottom plate are power supplied by connecting the upper segment of the T-shaped external mold and the water-cooled bottom plate respectively with two terminals of a secondary output end of one transformer through a copper bar flexibly to form a high current loop; the electrodes and the water-cooled bottom plate are respectively connected with two terminals of the other transformer through a copper bar flexibly to form another high current loop.

Hollow ingot for retaining ring of large generator prepared according to the method has the outside diameter of 650 to 900 mm and the inside diameter of 450 to 500 mm.

Each of the consumable electrode lifting devices is fixed on a frame carriage; when one consumable electrode assembly is to be replaced, the former consumable electrode lifting device is removed by a frame carriage from the remelting position, and the next consumable electrode lifting device is moved by next frame carriage to the remelting position for electroslag remelting of the next consumable electrode assembly.

The control system is a two-stage computer control system composed of a PLC and an industrial control computer.

The present invention is based on the traditional electroslag remelting technology and creatively adopts the key technology and processes of T-shaped current supply mold, two power supplies for heating and supplying power, water cooled internal and external molds, frame carriage electrode lifting device and liquid metal level detecting device to manufacture hollow ingots directly by electroslag remelting; the method of the present invention has the following advantages:

1. When a hollow ingot prepared by the method of the present invention is used to produce a retaining ring of a large generator, upsetting and punching processes can be saved, heating number can be reduced, and therefore, the method is not only easy to operate, but also can save time and energy and increase material utilization rate; large cylinder forging or pipe with large diameter and thick wall can be produced by using small-capacity pressure processing device rather than large pressure processing equipment;
2. As a T-shaped external mold is used, that is the mold diameter of the consumable electrode melting part is greater than that of the ingot shaping part, the filling ratio can be increased, and therefore the length of the consumable electrode and the height of the furnace can be reduced; multiple consumable electrodes connected in parallel are used, therefore the diameter of the consumable electrodes can be increased and the consumable electrodes are easy to get ready for production;
3. As two transformers are used for power supplying and heating the slag bath in the mold continuously, slag temperature is kept from declining rapidly when exchanging the consumable electrode assembly, and thus avoiding the phenomenon of forming deep slag ditches on the surface of ingot due to the rapid decline of the slag temperature when exchanging the electrode in production by traditional method; whereas the slag ditches are deeper due to the hollow ingot is cooled internally and externally, and the electrodes is difficult to exchange because the internal mold is prone to biting due to ingot solidification shrinkage; a longer hollow ingot can be prepared by remelting through multiple electrode assemblies exchange, therefore solving the problem that the length of the hollow ingot produced by traditional method is limited;

4. As combined type water cooled internal and external molds are used, the effect of hollow forming is obtained, and the internal and external molds both have cooling function, and therefore the hollow ingot can be cooled internally and externally during molten steel solidification; as a result, the cooling intensity is increased, the segregation level of the finally solidified part is reduced, and the uniformity of the composition is greatly increased compared with ordinary solid ingot; meanwhile, slag skin with a certain thickness is formed on both the internal and external surfaces of the hollow ingot, therefore, good quality of internal and external surfaces can be obtained;
5. As the liquid metal level detecting device is used, the accurate position of the slag-metal level can be detected; the melting rate is controlled to match accurately with the withdrawing speed in order to ensure that a metal pool is shallow in shape, thus to obtain excellent surface quality and interior quality.

As the method of the present invention adopts T-shaped molds, filling ratio is increased, the length of the electrode is reduced, and meanwhile, hollow ingots of different sizes can be prepared by remelting through replacing the internal and external molds with different sizes; as two power supplies and current supplying mold technology are used, the quality of the internal and external surfaces of hollow ingot can be ensured when exchanging the electrodes; as combined type water cooled internal and external molds are used, the hollow ingot has the advantages of compact structure, uniform composition, good thermoplasticity and lower compression ratio for processing; the consumable electrodes can be exchanged repeatedly by moving each frame carriage carrying an electrode lifting device so as to reduce the length requirements for the consumable electrodes; as the liquid metal level detecting device is used, the level of the liquid metal in the mold can be monitored in real time, thus to match corresponding withdrawing speed with the melting rate of the consumable electrode; as premelting slag with a certain composition is used, the problems of slag and steel leakage can be avoided, and meanwhile, the quality of the internal and external surfaces of the hollow ingot can be ensured.

According to the present invention, molten slag is added to the annular space formed by the internal mold, the external mold and water-cooled bottom plate on the withdrawing device, the end part of each consumable electrode is inserted into the annular space. When multiple consumable electrodes connected in parallel form a power supply circuit together with the slag and the water-cooled bottom plate through a high current loop, there is a current output from the transformer and passing through the molten slag to make the end part of each consumable electrode heat and melt gradually; liquid metal drops pass through the slag bath and enters the metal pool; as the metal pool is cooled by the internal and external molds, the liquid metal solidifies gradually and forms a hollow ingot. When the height of the hollow ingot reach a certain value, withdrawing starts; the withdrawing speed shall be matched with the melting rate of the consumable electrode, and the level of the liquid metal in the mold is monitored by the liquid metal level detecting device.

Theoretical analysis and experimental results show that as the hollow ingot prepared by electroslag remelting is compulsorily cooled by water with the internal and external molds, the solidification quality of the hollow ingot can be effectively controlled, and large temperature gradient makes the liquid metal solidify quickly under the action of two opposite solidification fronts, therefore refined solidification structure of the ingot is ensured, transverse plasticity and toughness as well as the indexes such as anisotropy, fracture toughness, notch sensitivity and low cycle fatigue are significantly improved, and the ingot has the advantages of high cleanliness, compact structure, uniform composition, good thermoplasticity and lower compression ratio for processing; the hollow ingot prepared by electroslag remelting is directly used for producing large retaining ring forging, therefore the heating number for forging can be reduced greatly, crack formation during forging can be significantly alleviated, and grain growth caused by repeated heating can be avoided; when the hollow ingot prepared by the method of the present invention is used as the material for producing retaining ring of large generator, punching process can be saved, heating number and forging number can be reduced, forging cracks can be reduced, interior quality of the ingot can be ensured, and the production cost and production cycle of retaining rings with large caliber can be substantially reduced; compared with the method of using a solid ingot as forging material to prepare a retaining ring forging, the method of directly using a hollow ingot to prepare a retaining ring forging of the same size can save material cost by at least 15%, heating cost by at least 50%, and forging cost by at least 30%.

DETAILED DESCRIPTION OF THE PREFERRED EMBODIMENTS

The fluorite used in the embodiments of the present invention is fluorite powder with the weight purity not less than 97% or fluorite granules with the weight purity not less than 97%; the weight content of CaO in lime used is not less than 92%; the weight purity of $Al_2O_3$ in industrial alumina used is not less than 99%; the weight purity of MgO in fused magnesite used is not less than 97%; the weight purity of $SiO_2$ in silica used is not less than 98%; the above materials are prepared into slag by a method disclosed according to a low-pollution energy-saving slag system for preparing hollow ingot through withdrawing-type electroslag remelting with the Chinese patent application number of 201310239951.X.

The molten steel level detecting device used in the embodiments of the present invention is MLOC-2M liquid metal level detecting device manufactured by Elmet-Roll, Ukraine.

The consumable electrode with the diameter of 160 mm used in the embodiments of the present invention is produced by an EAF+LF+VD process and rolling.

The electroslag remelting hollow ingot mold used in the embodiments of the present invention has the following sizes: 650 to 900 mm for the diameter of the T-shaped external mold, and 450 to 500 mm for the diameter of the internal mold.

Figure 1:
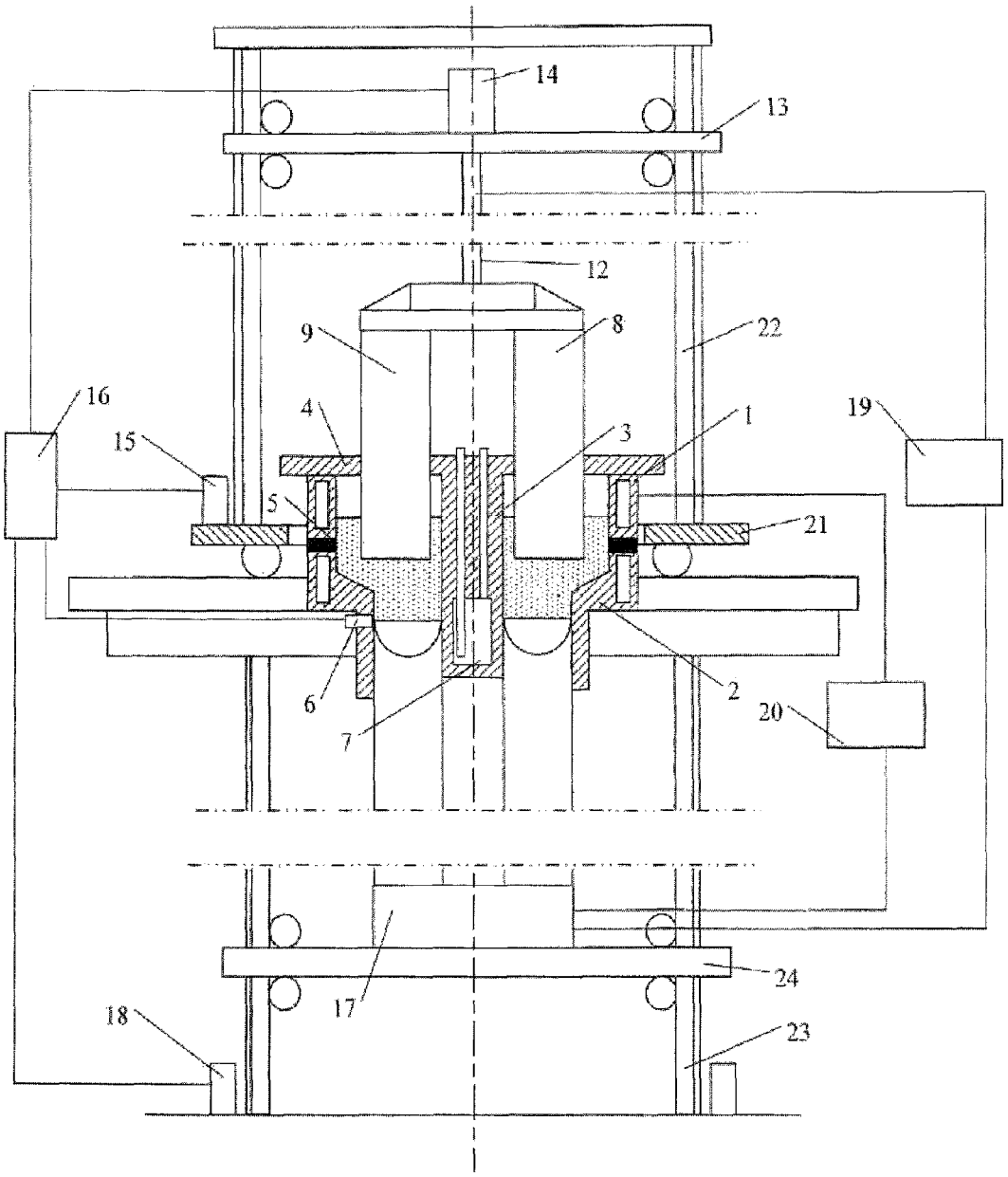
FIG. 1 is the structure diagram of the device for manufacturing hollow ingot for retaining ring of large generator by electroslag remelting in the embodiments of the present invention.

The device for preparing hollow ingot for retaining ring of large generator by electroslag remelting in the embodiments of the present invention has the structure shown in FIG. 1, comprising an electroslag remelting hollow ingot mold, a water-cooled bottom plate 17, consumable electrode lifting devices and a withdrawing device.

The electroslag remelting hollow ingot mold is composed of a T-shaped external mold and an internal mold; the internal mold is composed of a water cooled sleeve 3 and a cross beam 4 on the top of the water cooled sleeve 3, the cross beam 4 is fixed on the upper flange of the T-shaped external mold, and a cooling water channel 7 is arranged in the water cooled sleeve 3 for allowing cooling water to flow; the T-shaped external mold comprises an upper segment 1 and a lower segment 2, between which an insulation blanket 5 is arranged and which are respectively installed with a water cooled device; the lower segment 2 of the T-shaped external mold is also installed with a liquid metal level detecting device 6.

The liquid metal level detecting device 6 is 60 to 80 mm below the insulation blanket 5.

The water-cooled bottom plate 17 is arranged at the bottom of the electroslag remelting hollow ingot mold; the water-cooled bottom plate 17 is respectively connected with one terminal of each transformer (transformer I 19 and transformer II 20) through a copper bar, wherein the other terminal of one transformer (transformer I 19) is connected with a stub 12 through a copper bar, and the other terminal of the other transformer (transformer II 20) is connected with the upper segment 1 through a copper bar.

Each consumable electrode lifting device comprises a lifting device driving motor 14, an electrode cross arm 13 and a stub 12; the other terminal of the transformer I 19 is connected with the stub 12 through a copper bar; a consumable electrode assembly is arranged below the stub 12, and the consumable electrode assembly is composed of a consumable electrode assembly right part 8 and a consumable electrode assembly left part 9 which have the same size and are symmetrically distributed at both sides.

Each consumable electrode lifting device is fixed on a frame carriage which comprises a frame cart base 21 and a frame carriage driving motor 15.

The withdrawing device comprises a withdrawing device bottom plate 24 and a withdrawing device driving motor 18.

The withdrawing device driving motor 18, the lifting device driving motor 14, the frame carriage driving motor 15 and the liquid metal level detecting device 6 are all connected with a control system 16 through wires.

Embodiment 1

1. Preparing a number of consumable electrode assemblies, each of which is composed of two parts with the same size; each part comprises five consumable electrodes; the two parts with the same size of the consumable electrode assembly are symmetrical and are connected in parallel and distributed at both sides of the cross beam;
2. Adding slag into a slag melting furnace, and powering on to melt the slag into molten slag; the slag contains 35% of $CaF_2$, 35% of CaO, 10% of $Al_2O_3$, 5% of MgO and 15% of $SiO_2$ by weight percentage;
3. Before pouring the molten slag, lowering the consumable electrode assembly by consumable electrode lifting devices and inserting them into an electroslag remelting hollow ingot mold; before molten slag pouring, during electroslag remelting and before demoulding, there is cooling water flowing in the water cooled channel and in the water cooled devices of the upper segment and the lower segment of the T-shaped external mold;
4. Switching on the transformer I and the transformer II;
5. Pouring the molten slag into the mold when the molten slag is heated to 1650° C. to 1680° C.;
6. As the slag level of the molten slag rises with slag pouring, forming an electric circuit among the transformer I, the stub, the consumable electrode assembly and the water-cooled bottom plate when the consumable electrode assembly comes into contact with the molten slag, and stopping pouring molten slag when the current reaches 8 kA;
7. After pouring the molten slag into the mold, forming a circuit among the upper segment, the water-cooled bottom plate and the transformer II when the molten slag comes into contact with the upper segment, and the current increases with pouring of the molten slag and rising of slag temperature;
8. Regulating the output current and voltage of the two transformers to the process set value, wherein the current of the transformer I is regulated to the process set value of current by electrode movement, and the voltage of the transformer I is regulated to the process set value of voltage by a saturable reactor; meanwhile, regulating the output voltage of the transformer II to keep the current within 8 to 10 kA when the current of the transformer II reaches 5 to 6 kA;
9. The consumable electrode assemblies gradually melt in the molten slag, and the formed metal drops gradually gather to the space between the mold and the water-cooled bottom plate, so that the level of the liquid metal rises gradually; when the level of the liquid metal comes into contact with the liquid metal level detecting device, the liquid metal level detecting device gets a detection signal; at this time, the withdrawing device is started to drive the water-cooled bottom plate to descend for withdrawing;
10. Exchanging the consumable electrode assembly when the height of the remaining part of the consumable electrodes is 80 mm; lifting the remaining consumable electrode assemblies through the consumable electrode lifting devices to separate from the molten slag, which makes the current between the stub and the water-cooled bottom plate to be cut off; Meanwhile, power supplying the upper segment of the T-shaped external mold and the water-cooled bottom plate continuously to keep difference between the temperature of the molten slag and the temperature of the slag during electroslag remelting not more than 30° C. so as to avoid slag solidification caused by rapid decline of the temperature of the molten slag due to power cut;
11. Inserting a subsequent consumable electrode assembly into the molten slag in the mold by the consumable electrode lifting device until the current circuit formed among the stub, the consumable electrode assembly and the water-cooled bottom plate reaches 8 to 9 kA, and repeating steps 8 to 10 until withdrawing is completed, thereby obtaining large hollow ingots for retaining ring of large generator, with the size of 650/450 mm.

When one consumable electrode assembly is to be replaced, the former consumable electrode lifting device is removed by a frame carriage from the remelting position, and the next consumable electrode lifting device is moved by next frame carriage to the remelting position for electroslag remelting of the next consumable electrode assembly.

A computer is used as a control system, and a PLC used as a lower computer and an industrial control computer used as an upper computer form a secondary monitoring system.

The diameter of the T-shaped external mold is 650 mm, and the diameter of the internal mold is 450 mm; the amount of molten slag used is calculated under the condition of ensuring that the height of the slag bath is 260 to 280 mm, i.e. 240 to 260 kg of a single heat. The voltage is 63 to 68 V (the process set value of voltage), the current is 18 to 20 kA (the process set value of current), the melting rate is 800 to 970 kg/h, and the withdrawing speed for hollow ingot is 10 to 12 mm/min.

The consumable electrode for electroslag remelting is made of 1Mn18Cr18N steel.

Figure 2:
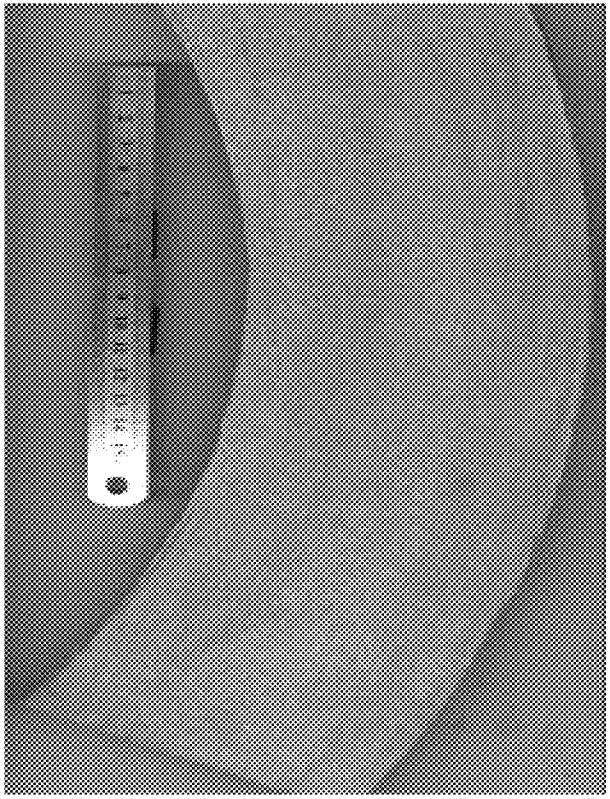
FIG. 2 is the macrostructure of the hollow ingot prepared by electroslag remelting in the embodiments of the present invention

The internal surface and the external surface of the hollow ingot by electroslag remelting have good quality without slag ditch, scab, lap, fold, slag inclusion, etc. After vertically and horizontally dissecting electroslag hollow ingot, polish the surfaces, and no obvious macro defects are found. After corrosion, the macrostructure of the electroslag hollow ingot is shown in FIG. 2. It can be seen that the structure of the electroslag hollow ingot is compact without macroscopic defects such as porosity, shrinkage, segregation, etc., which fully confirms the advantages of the process of electroslag remelting for hollow ingot. The composition of consumable electrode and the sampled composition of electroslag hollow ingot for analysis (by weight percentage) are shown in Table 1.

TABLE 1

| Sampling Location | C | Si | Mn | Cr | N | P | S |
|---|---|---|---|---|---|---|---|
| Standard Range | ≤0.10 | ≤0.60 | 17.5-20.0 | 17.5-20.0 | 0.50-0.70 | ≤0.025 | ≤0.008 |
| Consumable Electrode | 0.072 | 0.47 | 18.6 | 19.5 | 0.65 | 0.02 | 0.005 |
| Head of Hollow Ingot | 0.071 | 0.45 | 18.2 | 19.4 | 0.62 | 0.02 | 0.002 |
| Tail of Hollow Ingot | 0.075 | 0.43 | 18.0 | 19.3 | 0.62 | 0.02 | 0.002 |

From comparison of the chemical composition of the consumable electrode and the sampled chemical composition of the head and tail of hollow ingot in Table 1, it can be seen that elements of the head and tail have less deviation and are distributed equally. In addition, the burning loss of carbon, silicon and manganese elements is low, but harmful elements are reduced significantly, in particular, the desulfurization capacity is strong, the average desulfurization ratio is about 50%, but the other elements are essentially unchanged, which fully exert the advantages of the electroslag remelting process.

Embodiment 2

The slag contains 40% of $CaF_2$, 30% of CaO, 15% of $Al_2O_3$, 1% of MgO and 14% of $SiO_2$ by weight percentage;

The electroslag remelting method is the same as the embodiment 1, and the differences are:

(1) In step 6, stopping pouring molten slag when the current reaches 9 kA;

(2) In step 8, regulating the voltage of the transformer I to 63 to 68 V (the process set value of voltage) and the current to 18 to 20 kA (the process set value of current), and regulating the output voltage of the transformer II to keep the current at 9 kA when the current of the transformer II reaches 5.5 kA;

(3) In step 10, exchanging the consumable electrode assemblies when the height of the remaining part of the consumable electrodes is 60 mm;

(4) The mold has the following sizes: 900 mm for the diameter of the external mold and 500 mm for the diameter of the internal mold; the amount of molten slag used shall ensure that the height of the slag bath is 300 to 350 kg of a single heat; the voltage is 72 to 76 V, the current is 20 to 22 kA, the melting rate is 1000 to 1100 kg/h, and the withdrawing speed under the action of control system is 5 to 6 mm/min.

The size of the hollow ingot is 900/500 mm, the internal surface and the external surface of the hollow ingot have good quality without obvious slag ditch, scab, etc., and the total weight content of non-metallic inclusions is reduced by 62%.

Embodiment 3

The slag contains 39% of $CaF_2$, 34% of CaO, 14% of $Al_2O_3$, 3% of MgO and 10% of $SiO_2$ by weight percentage;

The electroslag remelting method is the same as the embodiment 1, and the differences are:

(1) In step 7, stopping pouring molten slag when the current reaches 9 kA;

(2) In step 8, regulating the voltage of the transformer I to 62 to 66 V (the process set value of voltage) and the current to 22 to 24 kA (the process set value of current), and regulating the output voltage of the transformer I to keep the current at 10 kA when the current of the transformer II reaches 6 kA;

(3) In step 10, exchanging the consumable electrode assembly when the height of the remaining part of the consumable electrodes is 50 mm;

(4) The diameter of the T-shaped external mold is 900 mm, and the diameter of the internal mold is 200 mm; the amount of molten slag used shall ensure that the height of the slag bath is 360 to 380 kg of a single heat; the voltage is 62 to 66 V, the current is 22 to 24 kA, the melting rate is 850 to 950 kg/h, and the withdrawing speed under the action of control system is 3 to 3.6 mm/min.

The size of the prepared hollow ingot is 900/200 mm, the internal surface and the external surface of the hollow ingot have good quality without obvious slag ditch, scab, etc., and the total weight content of non-metallic inclusions is reduced by 65%.

What is claimed is:

1. A method for manufacturing hollow ingot for retaining ring of large generator by using electroslag remelting characterized by comprising the following steps:

(1) preparing a number of consumable electrode assemblies, each of which is composed of two parts with the same size;

(2) adding slag into a slag melting furnace, and powering on to melt the slag into molten slag;

(3) before pouring the molten slag, lowering the consumable electrode assembly by consumable electrode lifting devices and inserting them into a mold for electroslag remelting of hollow ingot; the mold mentioned above is composed of a T-shaped external mold and an internal mold; the internal mold is composed of a water cooled sleeve and a cross beam on the top of the water cooled sleeve, the cross beam is fixed on an upper flange of the T-shaped external mold, and a cooling water channel is arranged in the water cooled sleeve for allowing cooling water to flow; the T-shaped external mold comprises an upper segment and a lower segment, between which an insulation blanket is arranged and which are respectively installed with a water cooled device; the insulation blanket is located below the level of molten slag; the lower segment of the T-shaped external mold is also provided with a liquid metal level detecting device; before molten slag pouring, during electroslag remelting and before demoulding, there is cooling water flowing in the cooling water channel of the water cooled sleeve and in the water cooled devices of the upper segment and the lower segment of the T-shaped external mold;

(4) connecting a stub and a water-cooled bottom plate respectively with two terminals of one transformer; connecting the upper segment of the T-shaped external mold and the water-cooled bottom plate respectively with two terminals of the other transformer; switching on the two transformers;

(5) pouring the molten slag into the mold when the molten slag is heated to 1650° C. to 1680° C.;

(6) as the level of the molten slag rises with slag pouring, forming an electric circuit among the stub, the consumable electrode assembly and the water-cooled bottom plate when the consumable electrode assembly comes into contact with the molten slag, and stopping pouring molten slag when the current reaches 8 to 9 kA;

(7) after pouring the molten slag into the mold, forming a circuit among the upper segment, the water-cooled bottom plate and the transformer connected with them when the molten slag comes into contact with the upper segment, and the current increases with pouring of the molten slag and rising of slag temperature;

(8) regulating the output current and voltage of the two transformers to the process set value, wherein the current of the transformer connected with the stub and the water-cooled bottom plate is regulated to the process set value of current by electrode movement, and the voltage of the transformer is regulated to the process set value of voltage by a saturable reactor; meanwhile, regulating the output voltage of the transformer connected with the mold and the water-cooled bottom plate to keep the current of the transformer within 8 to 10 kA after the current of that transformer reaches 5 to 6 kA;

(9) the consumable electrode assembly gradually melt in the molten slag, and the formed metal drops through slag gradually gather to the space between the mold and the water-cooled bottom plate, so that the level of the liquid metal rises gradually; when the level of the liquid metal comes into contact with the liquid metal level detecting device, the liquid metal level detecting device gets a detection signal; at this time, a withdrawing device is started to drive the water-cooled bottom plate to descend for withdrawing;

(10) exchanging the consumable electrode assembly when the height of the remaining part of the consumable electrodes is 50 to 80 mm; lifting the remaining consumable electrode assembly through the consumable electrode lifting devices to separate from the molten slag, which makes the current between the stub and the water-cooled bottom plate to be cut off; whereas the power supplying the upper segment of the T-shaped external mold and the water-cooled bottom plate continuously to keep difference between the temperature of the molten slag and the temperature of the slag during electroslag remelting not more than 30° C. so as to avoid slag solidification caused by rapid decline of the temperature of the molten slag due to power cut; and

(11) inserting a subsequent consumable electrode assembly into the molten slag in the mold by the consumable electrode lifting device until the current circuit formed among the stub, the consumable electrode assembly and the water-cooled bottom plate reaches 8 to 9 kA, and repeating steps (8) to (10) until withdrawing is completed, thereby obtaining large hollow ingots for retaining ring of large generator.

2. The method according to claim 1, wherein the two parts of the same size of said consumable electrode assembly are symmetrical and are connected in parallel and distributed at both sides of the cross beam.

3. The method according to claim 1, wherein said slag contains 35%-40% of $CaF_2$, 30%-35% of CaO, 10%-15% of $Al_2O_3$, 1%-5% of MgO and 10%-15% of $SiO_2$ by weight percentage.

4. The method according to claim 1, wherein the upper segment of the T-shaped external mold and the water-cooled bottom plate are power supplied by connecting the upper segment of the T-shaped external mold and the water-cooled bottom plate respectively with two terminals of a secondary output end of one transformer through a copper bar flexibly to form a high current loop; the electrodes and the water-cooled bottom plate are respectively connected with two terminals of the other transformer through a copper bar flexibly to form another high current loop.

5. The method according to claim 1, wherein said hollow ingot for a retaining ring of a large generator has the outside diameter of 650 to 900 mm and the inside diameter of 450 to 500 mm.

6. The method according to claim 1, wherein each of said consumable electrode lifting devices is fixed on a frame cart; when one consumable electrode assembly is to be replaced, the former consumable electrode lifting device is removed by a frame carriage from the remelting position, and the next consumable electrode lifting device is moved by next frame carriage to the remelting position for electroslag remelting of the next consumable electrode assembly.

* * * * *